US009173541B2

(12) United States Patent
Han et al.

(10) Patent No.: US 9,173,541 B2
(45) Date of Patent: Nov. 3, 2015

(54) DISHWASHING MACHINE

(71) Applicant: LG Electronics Inc., Seoul (KR)

(72) Inventors: Shinwoo Han, Seoul (KR); Joonho Pyo, Seoul (KR); Younghwan Park, Seoul (KR); Daegyu Kim, Seoul (KR); Byeonghyeon Ju, Seoul (KR)

(73) Assignee: LG Electronics Inc., Seoul (KR)

( * ) Notice: Subject to any disclaimer, the term of this patent is extended or adjusted under 35 U.S.C. 154(b) by 115 days.

(21) Appl. No.: 14/019,584

(22) Filed: Sep. 6, 2013

(65) Prior Publication Data

US 2014/0076369 A1 Mar. 20, 2014

(30) Foreign Application Priority Data

Sep. 19, 2012 (KR) ..... 10-2012-0103852
Sep. 25, 2012 (KR) ..... 10-2012-0106357
Sep. 25, 2012 (KR) ..... 10-2012-0106358

(51) Int. Cl.
*A47L 15/23* (2006.01)
*A47L 15/50* (2006.01)
*A47L 15/42* (2006.01)

(52) U.S. Cl.
CPC ..... *A47L 15/23* (2013.01); *A47L 15/428* (2013.01); *A47L 15/4221* (2013.01); *A47L 15/508* (2013.01)

(58) Field of Classification Search
None
See application file for complete search history.

(56) References Cited

U.S. PATENT DOCUMENTS

| | | | | |
|---|---|---|---|---|
| 3,841,342 | A | 10/1974 | Cushing | |
| 3,951,683 | A | 4/1976 | Jarvis | |
| 4,174,723 | A | 11/1979 | Long | |
| 4,509,687 | A * | 4/1985 | Cushing | 239/245 |
| 5,427,129 | A * | 6/1995 | Young et al. | 134/176 |
| 2008/0271765 | A1 | 11/2008 | Burrows | |
| 2009/0090400 | A1 | 4/2009 | Burrows | |
| 2013/0276841 | A1 | 10/2013 | Han | |

FOREIGN PATENT DOCUMENTS

| | | | |
|---|---|---|---|
| CN | 101795613 | A | 8/2010 |
| EP | 2 656 772 | A2 | 10/2013 |
| WO | WO 2008/137818 | A1 | 11/2008 |
| WO | WO 2008/137820 | A1 | 11/2008 |
| WO | WO 2011/132358 | A1 | 10/2011 |

OTHER PUBLICATIONS

European Search Report dated Feb. 5, 2014 for Application No. 13184984.6, 7 pages.
Russian Decision on Grant dated Feb. 17, 2015 for Russian Application No. 2013142627, with English Translation, 17pages.
Chinese Office Action dated Aug. 4, 2015 for Chinese Application No. 201310428509.1, with English Translation, 11 pages.

* cited by examiner

*Primary Examiner* — Michael Barr
*Assistant Examiner* — Cristi Tate-Sims
(74) *Attorney, Agent, or Firm* — Fish & Richardson P.C.

(57) ABSTRACT

A dishwashing machine includes a lower arm disposed at a lower side of a lower rack to spray wash water to the lower rack, a rack fixing unit provided at the lower rack, and a tower nozzle fixed to the rack fixing unit to spray wash water to an upper rack. The dishwashing machine also includes a tower connection unit provided in the lower arm such that at least a portion of the tower connection unit is configured to move from the lower arm. The tower connection unit being connected to the tower nozzle to supply wash water to the tower nozzle based on the tower connection unit moving from the lower arm. The rack fixing unit includes a guide configured to guide movement of the tower connection unit withdrawn from the lower arm to the tower nozzle.

20 Claims, 11 Drawing Sheets

(a)

(b)

(a)

(b)

(a)

(b)

(a)

(b)

DISHWASHING MACHINE

This application claims the benefit of Korean Patent Application Nos. 10-2012-0103852, filed on Sep. 19, 2012, 10-2012-0106357, filed on Sep. 25, 2012 and 10-2012-0106358 filed on Sep. 25, 2012, which are hereby incorporated by reference as if fully set forth herein.

FIELD

The present disclosure relates to a dishwashing machine.

BACKGROUND

Generally, a dishwashing machine is a machine that includes a washing space that receives objects to be washed. The dishwashing machine supplies wash water to the objects to remove residue from the objects and, thus, clean the objects (and to even dry the objects according to circumstances).

FIG. 1 illustrates an example structure of a conventional dishwashing machine. The conventional dishwashing machine includes a cabinet 200 having a tub 210 to provide a washing space, an upper rack 220 and a lower rack 230 provided in the tub 210 to receive objects to be washed, a sump 240 disposed at the lower side of the tub 210 to store wash water, a lower arm 260 to spray wash water to the lower rack 230, an upper arm 250 to spray wash water to the upper rack 220, a pump P to supply the wash water stored in the sump 240 to the lower arm 260 through a first channel P1, and a second channel P2 diverging from the first channel P1 (or directly connected to the pump P) to supply wash water to the upper arm 250.

Wash water is supplied to the sump 240 through a water supply channel 241. The wash water is drained from the sump 240 through a drainage channel 243. Wash water introduced into the first channel P1 is supplied to the second channel P2 through a valve V. The second channel P2 supplies the wash water to the upper arm 250.

In the conventional dishwashing machine with the above-stated construction, the upper arm 250 is disposed between the upper rack 220 and the lower rack 230 to wash objects received in the upper rack 220. For this reason, the conventional dishwashing machine provides a space, in which the upper arm 250 is disposed between the upper rack 220 and the lower rack 230.

In addition, the second channel P2 to supply wash water to the upper arm 250 is disposed at the inner circumference of the tub 210. As a result, the length and shape of the racks 220 and 230 are restricted by the position of the second channel P2.

SUMMARY

In one aspect, a dishwashing machine includes a tub configured to define a washing space and an upper rack and a lower rack disposed in the tub and configured to receive objects to be washed. The dishwashing machine also includes a lower arm disposed at a lower side of the lower rack and configured to spray wash water to the lower rack, a rack fixing unit provided at the lower rack, and a tower nozzle fixed to the rack fixing unit and configured to spray wash water to the upper rack. The dishwashing machine further includes a tower connection unit provided in the lower arm with at least a portion configured to move from the lower arm. The tower connection unit connects to the tower nozzle to supply wash water to the tower nozzle based on the tower connection unit being moved from the lower arm and the rack fixing unit includes a guide to guide movement of the tower connection unit from the lower arm to the tower nozzle.

Implementations may include one or more of the following features. For example, the rack fixing unit may include a rack fixing body removably fixed to the lower rack and a removable pipe coupling unit provided in the fixing body through hole. In this example, the rack fixing body may have a fixing body through hole that communicates with the tower nozzle and the removable pipe coupling unit may have a removable pipe receiving hole through which an outer circumference of the tower connection unit is inserted.

In some implementations, the guide may include a first inclined surface provided at the fixing body through hole such that the first inclined surface is inclined to the removable pipe receiving hole. In these implementations, the guide may include a second inclined surface provided at the removable pipe coupling unit such that the second inclined surface is connected to the first inclined surface. The second inclined surface may be inclined to the removable pipe receiving hole.

In some examples, the rack fixing unit may include a rack fixing body removably fixed to the lower rack. The rack fixing body may have a fixing body through hole that communicates with the tower nozzle. In these examples, the rack fixing unit may include a removable pipe coupling unit movably provided in the fixing body through hole to facilitate connection between the tower connection unit and the tower nozzle even when a center of the tower connection unit is not aligned with a center of the tower nozzle. Further, in these examples, the rack fixing body may include a flange location groove concavely bent toward the fixing body through hole and the removable pipe coupling unit may include a coupling unit body inserted through the fixing body through hole, a removable pipe receiving hole, through which an outer circumference of the tower connection unit is inserted, and a coupling unit flange provided at an outer circumference of the coupling unit body such that the coupling unit flange is supported in the flange location groove.

In addition, the coupling unit body may have a diameter less than a diameter of the fixing body through hole and the coupling unit flange may have a diameter greater than the diameter of the fixing body through hole and less than a diameter of the flange location groove. Also, the guide may include an inclined surface provided at the coupling unit body such that the inclined surface is inclined to the removable pipe receiving hole. Further, the removable pipe coupling unit may include a sealing unit provided in the removable pipe receiving hole such that the sealing unit contacts the outer circumference of the tower connection unit.

In some implementations, the sealing unit may be formed of an elastic material. In these implementations, the sealing unit may include a sealing unit through hole in which the outer circumference of the tower connection unit is received and a plurality of protrusions provided at the sealing unit through hole such that the protrusions are arranged at predetermined intervals.

In some examples, the dishwashing machine may include a water supply pump configured to supply wash water. In these examples, the portion of the tower connection unit may be configured to move from the lower arm and connect to the tower nozzle based on water pressure on the portion of the tower connection unit caused by operation of the water supply pump. Further, in these examples, the portion of the tower connection unit may be configured to disconnect from the tower nozzle and move to the lower arm based on a reduction in water pressure on the portion of the tower connection unit caused by discontinuing operation of the water supply pump.

In addition, the tower connection unit may be configured to alternate between connecting water supply to the tower nozzle and connecting water supply to the lower arm each time the portion of the tower connection unit moves from the lower arm. The portion of the tower connection unit may be configured to rotate each time the portion of the tower connection unit moves from the lower arm and connects to the tower nozzle and each time the portion of the tower connection unit disconnects from the tower nozzle and moves to the lower arm. The portion of the tower connection unit further may be configured to, at a first angle of rotation, connect water supply to the tower nozzle and block water supply to the lower arm and, at a second angle of rotation that is different than the first angle of rotation, connect water supply to the lower arm and block water supply to the tower nozzle.

In another aspect, a dishwashing machine includes a tub configured to define a washing space and an upper rack and a lower rack disposed in the tub and configured to receive objects to be washed. The dishwashing machine also includes a lower arm that includes a lower arm chamber, into which wash water is introduced, a removable pipe chamber communicating with the lower arm chamber via a chamber communication hole, and an arm channel communicating with the lower arm chamber via an arm channel communication hole. The arm channel is configured to spray wash water to the lower rack. The dishwashing machine further includes a rack fixing unit provided at the lower rack, a tower nozzle fixed to the rack fixing unit and configured to spray wash water to the upper rack, and a tower connection unit provided in the removable pipe chamber. The tower connection unit is moved from the removable pipe chamber and connected to the tower nozzle based on wash water being introduced into the removable pipe chamber and the rack fixing unit includes a guide configured to guide movement of the tower connection unit from the removable pipe chamber to the tower nozzle.

Implementations may include one or more of the following features. For example, the dishwashing machine may include a water supply pump configured to supply wash water to the lower arm chamber and a channel change unit provided in the lower arm chamber and configured to alternately open the chamber communication hole and the arm channel communication hole depending upon water pressure in the lower arm chamber controlled by the water supply pump. In this example, the channel change unit may include a change unit body configured to reciprocate and rotate in the lower arm chamber depending upon the water pressure in the lower arm chamber. The change unit body may have a chamber opening hole configured to open the chamber communication hole depending upon a rotational angle of the change unit body and an arm channel opening hole configured to open the arm channel communication hole depending upon the rotational angle of the change unit body.

In some implementations, the lower arm chamber may include an introduction hole, through which wash water is introduced, a lower gear engagement unit provided to surround the introduction hole, and an upper gear engagement unit provided at an upper side of the lower arm chamber. In these implementations, the channel change unit may include an upper gear provided at a top of the change unit body such that the upper gear is engaged with the upper gear engagement unit and rotates the change unit body such that, based on the upper gear being coupled to the upper gear engagement unit, the chamber opening hole opens the chamber communication hole or the arm channel opening hole opens the arm channel communication hole. Further, in these implementations, the channel change unit may include a lower gear provided at a bottom of the change unit body such that the lower gear is engaged with the lower gear engagement unit and rotates the change unit body such that, based on the lower gear being coupled to the lower gear engagement unit, the chamber opening hole opens the chamber communication hole or the arm channel opening hole opens the arm channel communication hole. The upper gear and the lower gear may be configured to alternately rotate the change unit body such that the chamber opening hole opens the chamber communication hole a first instance in which the upper gear is coupled to the upper gear engagement unit and the arm channel opening hole opens the arm channel communication hole a second instance in which the upper gear is coupled to the upper gear engagement unit, the second instance immediately following the first instance.

DETAILED DESCRIPTION

Figure 1:
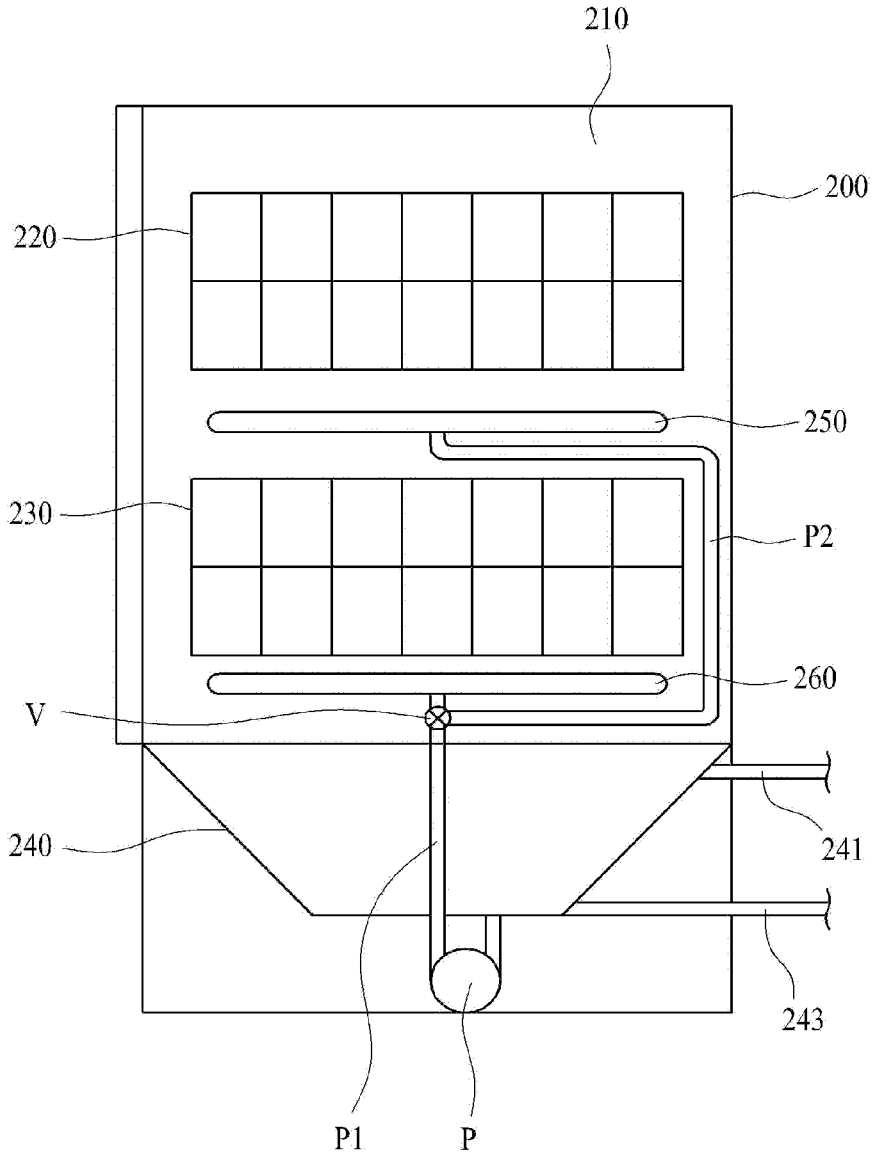
FIG. 1 is a view showing an example structure of a conventional dishwashing machine.
Figure 2:
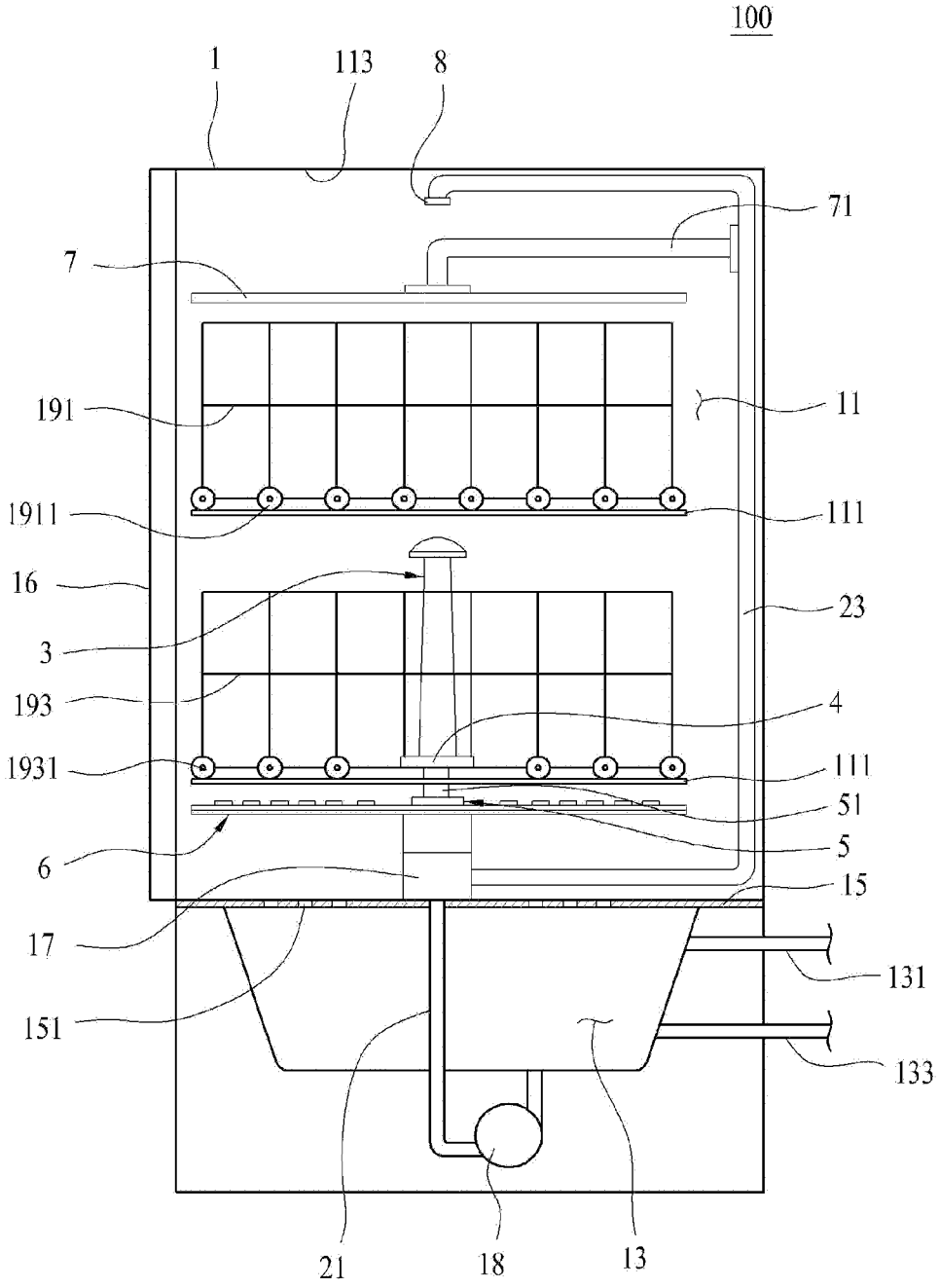
FIG. 2 is a view showing an example structure of an example dishwashing machine.

FIG. 2 illustrates an example structure of an example dishwashing machine 100. The dishwashing machine 100 includes a cabinet 1 forming the external appearance of the dishwashing machine, a tub 11 disposed in the cabinet 1 to provide a washing space, a sump 13 disposed at the lower side of the tub 11 to store wash water, a sump cover 15 disposed at the upper side of the sump 13 to isolate the tub 11 and the sump 13 from each other, and a door 16 provided at the cabinet 1 to open and close the washing space.

The sump 13 is connected to a sump water supply channel 131 to supply wash water. In addition, the sump 13 is connected to a sump drainage channel 133 to drain wash water from the sump 13. The sump cover 15 is provided with collection holes 151 to collect wash water sprayed into the washing space through spray nozzles 6 and 7 or a top nozzle 8, which will be described below, into the sump 13.

In the tub 11, a rack is provided to receive objects, such as dishes, to be washed. The rack may include a first rack 191 and a second rack 193 disposed at the lower side of the first rack 191. Hereinafter, the first rack 191 will be referred to as an upper rack and the second rack 193 will be referred to as a lower rack for the sake of convenience.

The upper rack 191 and the lower rack 193 may be withdrawn from the tub 11 when the washing space is opened by the door 16. To this end, rails 111 extending from the rear of the tub 11 to the door 16 may be provided in the washing space. In addition, the upper rack 191 and the lower rack 193 may be provided with wheels 1911 and 1931, by which the upper rack 191 and the lower rack 193 are supported on the rails 111.

Meanwhile, the dishwashing machine 100 may further include a lower arm 6 provided in the tub 11 to wash objects received in the lower rack 193 and an upper arm 7 provided in the tub 11 to wash objects received in the upper rack 191.

In addition, the dishwashing machine 100 may further include a top nozzle 8 disposed at the top 113 of the tub 11 to spray wash water.

The lower arm 6 is rotatably fixed in the tub by an arm holder 17 fixed to the sump cover 15 to receive wash water stored in the sump 13 through a water supply pump 18 and a water supply channel.

The water supply channel may include a first channel 21 connected between the water supply pump 18 and the arm holder 17 and a second channel 23 connected between the arm holder 17 and the top nozzle 8. In this case, the upper arm 7 may be connected to the second channel 23 via a second channel connection pipe 71.

Consequently, wash water discharged from the sump 13 through the water supply pump 18 is supplied to the arm holder 17 through the first channel 21. Some of the wash water supplied to the arm holder 17 is supplied to the lower arm 6 communicating with the arm holder 17 and the remainder of the wash water flows along the second channel 23.

In this regard, some of the wash water introduced into the second channel 23 is supplied to the upper arm 7 through the second channel connection pipe 71 and the remainder of the wash water flows to the top nozzle 8.

The upper arm 7 is disposed at the upper side of the upper rack 191. The upper arm 7 may be rotatably coupled to the second channel connection pipe 71 such that, when wash water is sprayed, the upper arm 7 can be rotated by repulsive force of the wash water.

The top nozzle 8 is provided at a position (the top 113 of the tub 11) higher than the upper arm 7. The top nozzle 8 receives wash water from the second channel 23 and sprays the wash water to the upper rack 191 and the lower rack 193.

Furthermore, the dishwashing machine 100 may further include a tower nozzle 3 that is fixed to the lower rack 193, and that extends to the upper rack 191. The dishwashing machine 100 also includes a tower connection unit 5 provided in the lower arm 6 such that the tower connection unit 5 is connected to or disconnected from the tower nozzle 3 depending upon water pressure in the lower arm 6.

Figure 3:
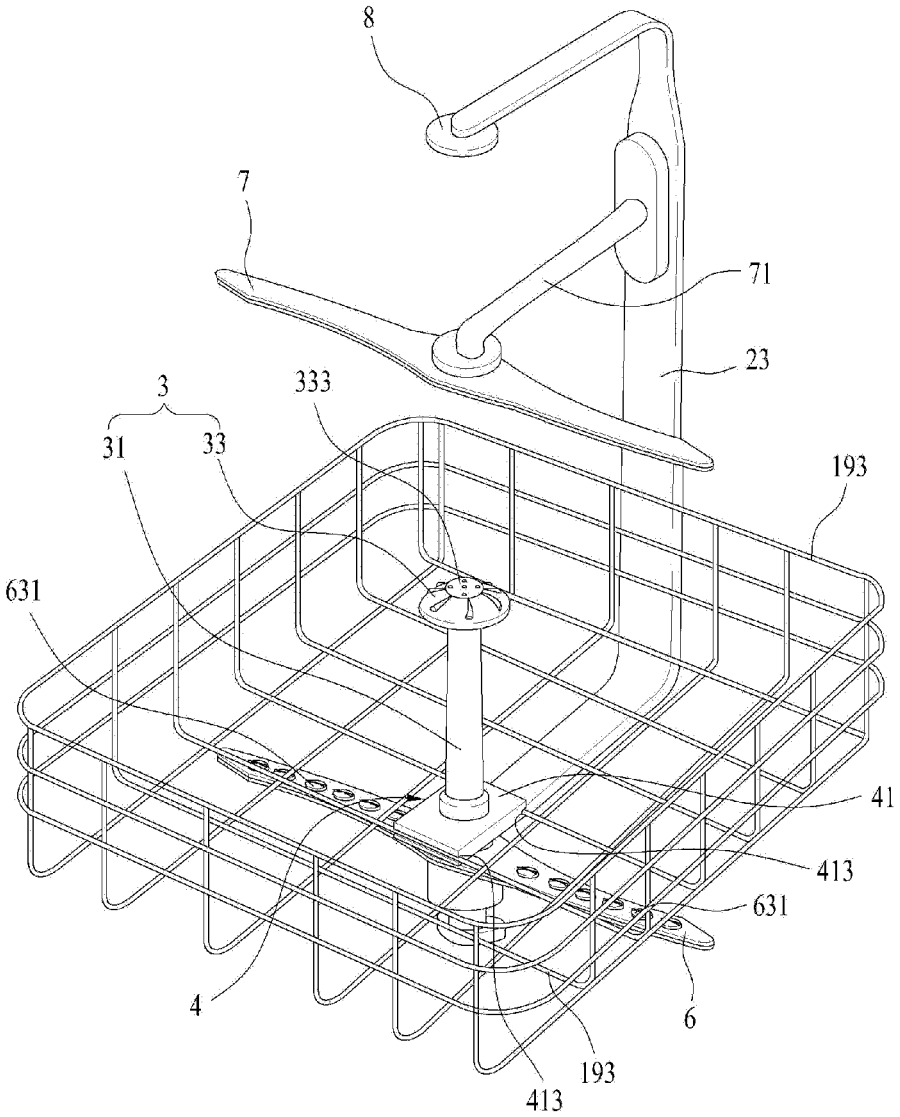
FIG. 3 is a view showing an example coupling structure of an example tower nozzle and an example lower rack of the example dishwashing machine.
Figure 4:
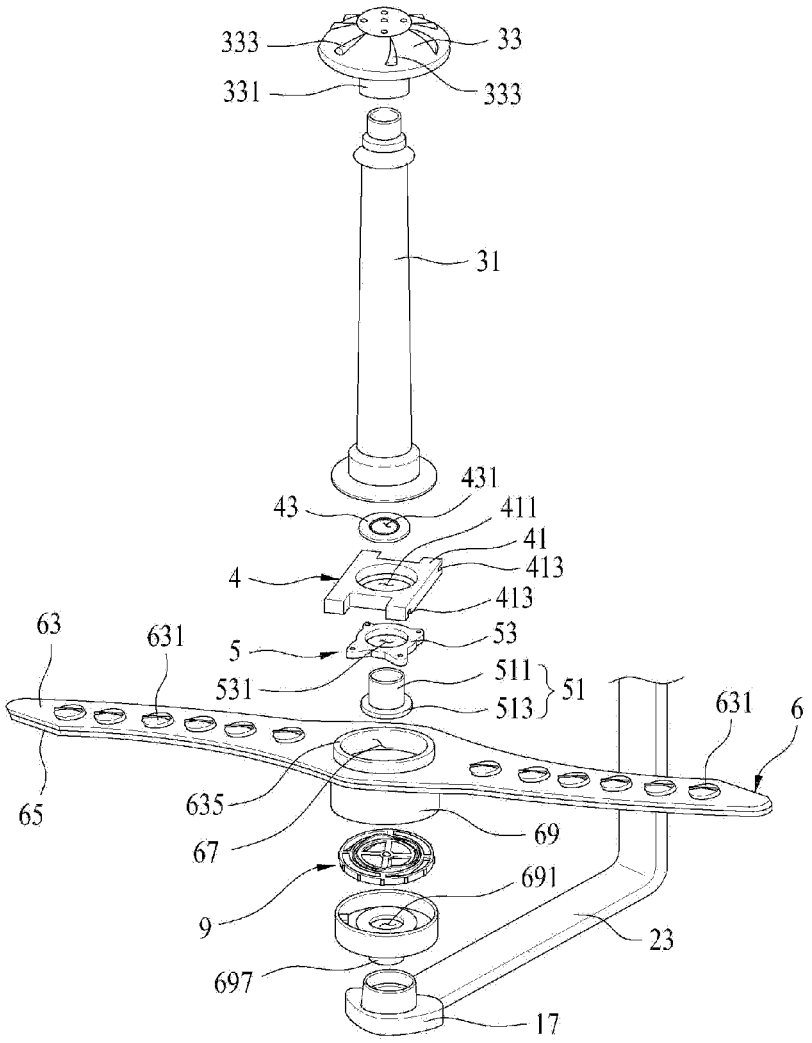
FIG. 4 is an exploded perspective view showing the example tower nozzle, an example rack fixing unit, an example tower connection unit, and an example lower arm of the example dishwashing machine.
Figure 4:
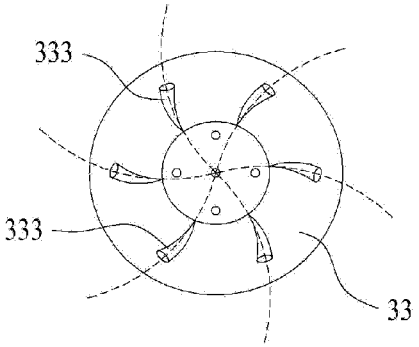

As shown in FIGS. 3 and 4, the tower nozzle 3 may be removably connected to lower rack 193 via a rack fixing unit 4. The tower nozzle 3 may include a tower channel 31 coupled to the rack fixing unit 4 such that wash water supplied through the tower connection unit 5 flows along the tower channel 31 and a spray nozzle 33 to spray wash water supplied through the tower channel 31.

The tower channel 31 has a cylindrical shape opened at the top and bottom thereof. The spray nozzle 33 is coupled to the open top of the tower channel 31 and the rack fixing unit 4 is coupled to the open bottom of the tower channel 31.

The tower channel 31 may have a diameter gradually decreased from the bottom to the top thereof such that wash water introduced into the bottom of the tower channel 31 flows to the top of the tower channel 31 while water pressure of the wash water is uniformly maintained.

As shown in FIG. 4(*a*), the spray nozzle 33 may include a connection pipe 331 coupled to the top of the tower nozzle 3 and a plurality of spray holes 333, through which wash water introduced into the spray nozzle 33 through the connection pipe 331 is discharged from the spray nozzle 33.

The connection pipe 331 couples the spray nozzle 33 to the tower channel 31 such that the spray nozzle 33 can be rotated. The spray holes 333 are configured such that the spray nozzle 33 can be rotated by repulsive force of the wash water discharged from the spray nozzle 33.

That is, the spray holes 333 are arranged at the top of the spray nozzle 33 in a spiral shape (see FIG. 4(*b*)) to rotate the spray nozzle 33 in a clockwise direction or in a counterclockwise direction when wash water is sprayed.

The rack fixing unit 4 includes a rack fixing body 41 fixed to the lower rack 193 (see FIG. 3) to support the tower channel 31.

As shown in FIG. 4, the rack fixing body 41 may include a fixing body through hole 411 and a rack coupling unit 413.

The rack fixing body 41 is removably connected to the lower rack 193 by the rack coupling unit 413. As shown in FIG. 4, the rack coupling unit 413 may be formed by concavely bending a portion of the rack fixing body 41.

Alternatively, the rack coupling unit 413 may be configured to have any structure (for example, a hook structure) by which the rack fixing body 41 can be removably connected to the lower rack 193.

The fixing body through hole 411 is formed through the rack fixing body 41. A removable pipe coupling unit 43 to which a removable pipe body 511 of the tower connection unit 5 is coupled may be provided in the fixing body through hole 411.

The removable pipe coupling unit 43 is provided with a removable pipe receiving hole 431, through which the removable pipe body 511 is inserted. When the removable pipe body 511 is inserted through the removable pipe receiving hole 431, the removable pipe body 511 is connected to the tower channel 31.

In addition, the dishwashing machine 100 may further include a tower connection unit 5 configured to be withdrawn from the lower arm 6.

The tower connection unit 5 is withdrawn from the lower arm 6 depending upon pressure in a removable pipe chamber 67, which will hereinafter be described, and is then connected to the removable pipe receiving hole 431. When the tower connection unit 5 is connected to the removable pipe receiving hole 431, wash water is supplied to the tower channel 31, which will hereinafter be described in more detail.

The tower connection unit 5 may include a tower removable pipe 51 configured to be withdrawn from the removable pipe chamber 67 of the lower arm 6 and an arm fixing body 53 fixed to the lower arm 6.

The tower removable pipe 51 may include a removable pipe body 511 formed in a cylindrical shape opened at the top and bottom thereof and a removable pipe flange 513 provided at the outer circumference of the removable pipe body 511.

Further, the removable pipe coupling unit 43, which is provided at the rack fixing unit 4, may be formed of an elastic material, such as rubber, to reduce (e.g., prevent) leakage of wash water supplied to the tower channel 31.

That is, when the removable pipe body 511 is withdrawn from the removable pipe chamber 67 by water pressure in the removable pipe chamber 67, the removable pipe body 511 is inserted through the removable pipe receiving hole 431. In a case in which the removable pipe coupling unit 43 is formed of an elastic material, the removable pipe body 511 comes into tight contact with the removable pipe receiving hole 431, thereby preventing wash water in the tower channel 41 from being discharged into a space defined between the removable pipe receiving hole 431 and the removable pipe body 511.

Furthermore, in a case in which the removable pipe coupling unit 43 is formed of an elastic material, it is possible to prevent wash water in the tower channel 41 from being discharged into the space defined between the removable pipe receiving hole 431 and the removable pipe body 511, even when the diameter of the removable pipe body 511 is greater than that of the removable pipe receiving hole 431.

The arm fixing body 53 includes a through hole 531, through which the removable pipe body 511 is inserted. The diameter of the through hole 531 is equal to or greater than that of the outer circumference of the removable pipe body 511 and is less than that of the removable pipe flange 513. In this case, the removable pipe body 511 is blocked from being withdrawn from the lower arm 6.

The lower arm 6 of the dishwashing machine 100 includes a lower arm chamber 69 communicating with the arm holder 17 such that wash water is introduced into the lower arm chamber 69, a removable pipe chamber 67 communicating with the lower arm chamber 69, the tower removable pipe 51 being received in the removable pipe chamber 67, and an arm channel 61 (see FIG. 5) communicating with the lower arm chamber 69.

Figure 5:
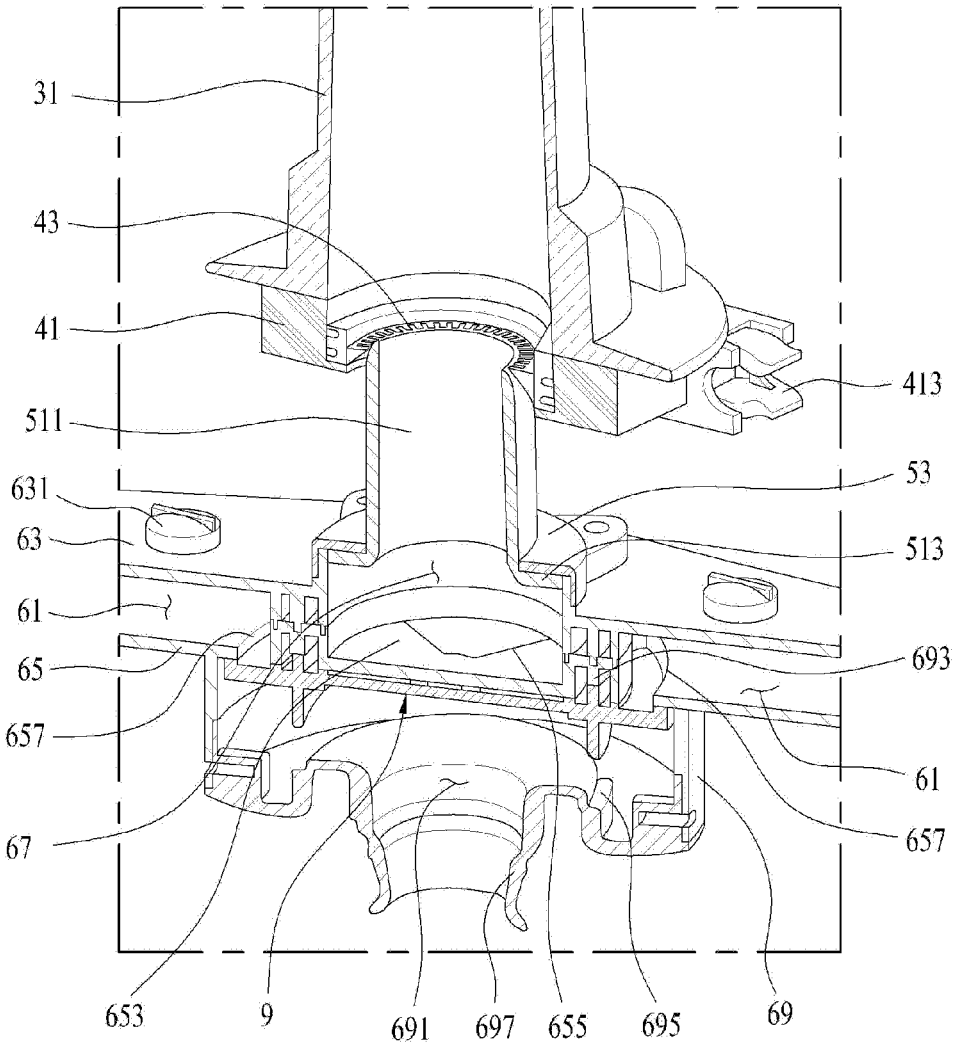
FIG. 5 is a view showing an example coupling structure of the example tower nozzle, the example rack fixing unit, the example tower connection unit, and the example lower arm.

As shown in FIG. 5, the arm channel 61 is defined by an upper frame 63 and a lower frame 65. The arm channel 61 communicates with the lower arm chamber 69 via arm channel communication holes 657.

Figure 6:
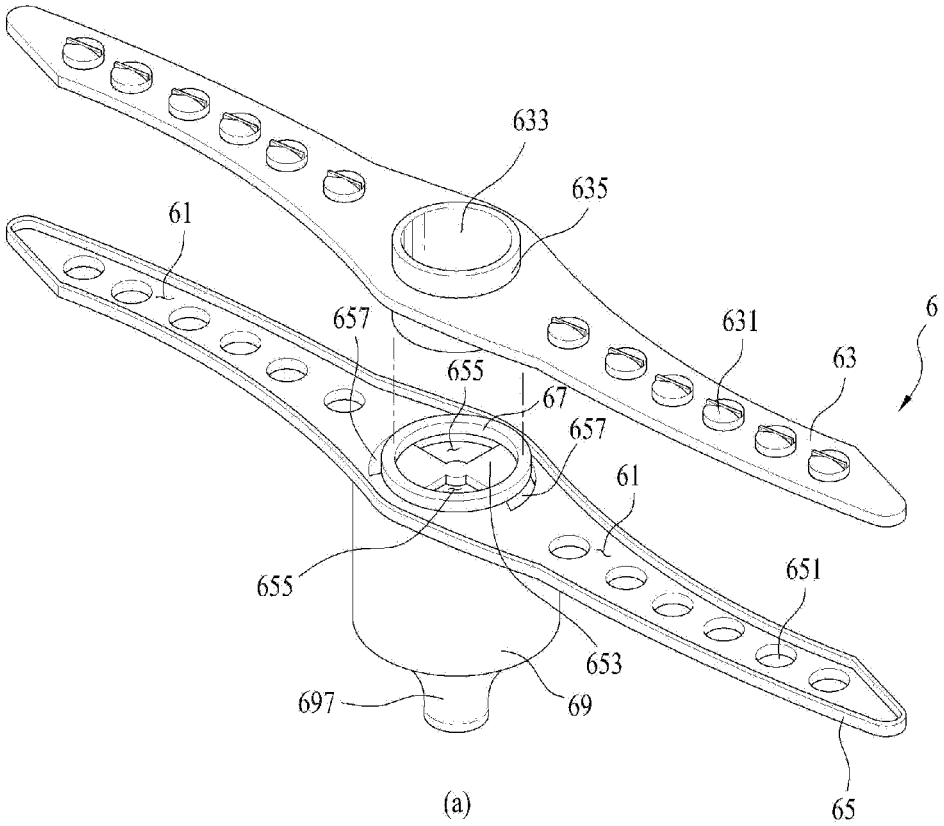
FIG. 6 is an exploded perspective view of the example lower arm.
Figure 6:
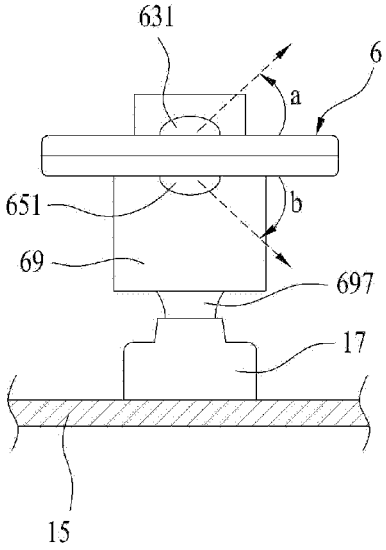

As shown in FIG. 6, the upper frame 63 includes upper spray holes 631 to spray wash water in the arm channel 61 to the lower rack 193, a frame through hole 633, in which the tower removable pipe 51 is received, and a fixing body connection unit 635, to which the arm fixing body 53 is coupled.

The lower frame 65 includes arm channel communication holes 657 to connect the lower arm chamber 69 and the arm channel 61, lower spray holes 651 to spray wash water introduced into the arm channel 61 to the sump 15, a chamber partition wall 653 to isolate the lower arm chamber 69 and the removable pipe chamber 67 from each other, and chamber communication holes 655 provided at the chamber partition wall 653 to connect the lower arm chamber 69 and the removable pipe chamber 67.

The removable pipe chamber 67 is disposed in a space defined between one of the arm channel communication holes 657 and the other of the arm channel communication holes 657. The removable pipe chamber 67 is configured as a wall extending from the surface of the lower frame 65 to the fixing body connection unit 635 of the upper frame 63.

As shown in FIG. 5, the lower arm chamber 69 is provided at the lower side of the lower frame 65 to surround the arm channel communication holes 657.

The lower arm chamber 69 includes an arm holder connection pipe 697 rotatably coupled to the arm holder 17, an introduction hole 691 formed through the arm holder connection pipe 697 such that wash water is introduced into the lower arm chamber 69 through the introduction hole 691, a lower gear engagement unit 695 provided at the bottom of the lower arm chamber 69, and an upper gear engagement unit 693 provided at the top of the lower arm chamber 69.

The lower gear engagement unit 695 is coupled to a lower gear 99 of a channel change unit 9, which will hereinafter be described, to rotate the channel change unit 9 by a predetermined angle. The lower gear engagement unit 695 may be provided along the outer circumference of the introduction hole 691.

The upper gear engagement unit 693 is coupled to an upper gear 97 of the channel change unit 9 to rotate the channel change unit 9 by a predetermined angle.

The upper gear engagement unit 693 may be provided at the top of the lower arm chamber 69 in a space defined between the removable pipe chamber 67 and the arm channel communication holes 657. That is, the upper gear engagement unit 693 may be provided in a space defined between the removable pipe chamber 67 and the arm channel communication holes 657 to surround the outer circumference of the removable pipe chamber 67.

As shown in FIG. 6(*b*), the upper spray holes 631 provided at the upper frame 63 may spray wash water at a predetermined angle a to the surface of the upper frame 63 such that the lower arm 6 can be rotated about the arm holder connection pipe 697 by repulsive force of wash water discharged from the arm channel 61.

In addition, the lower spray holes 651 provided at the lower frame 65 may spray wash water at a predetermined angle b to the surface of the lower frame 65 such that the lower arm 6 can be rotated about the arm holder connection pipe 697 by repulsive force of wash water discharged from the arm channel 61.

The lower spray holes 651 spray wash water to the sump cover 15. When the lower arm 6 is rotated, therefore, it is possible to reduce (e.g., prevent) clogging of the collection holes 151 of the sump cover 15 by foreign matter.

A channel change unit 9 to alternately open the chamber communication holes 655 and the arm channel communication holes 657 depending upon pressure in the lower arm chamber 69 is provided in the lower arm chamber 69.

Figure 7:
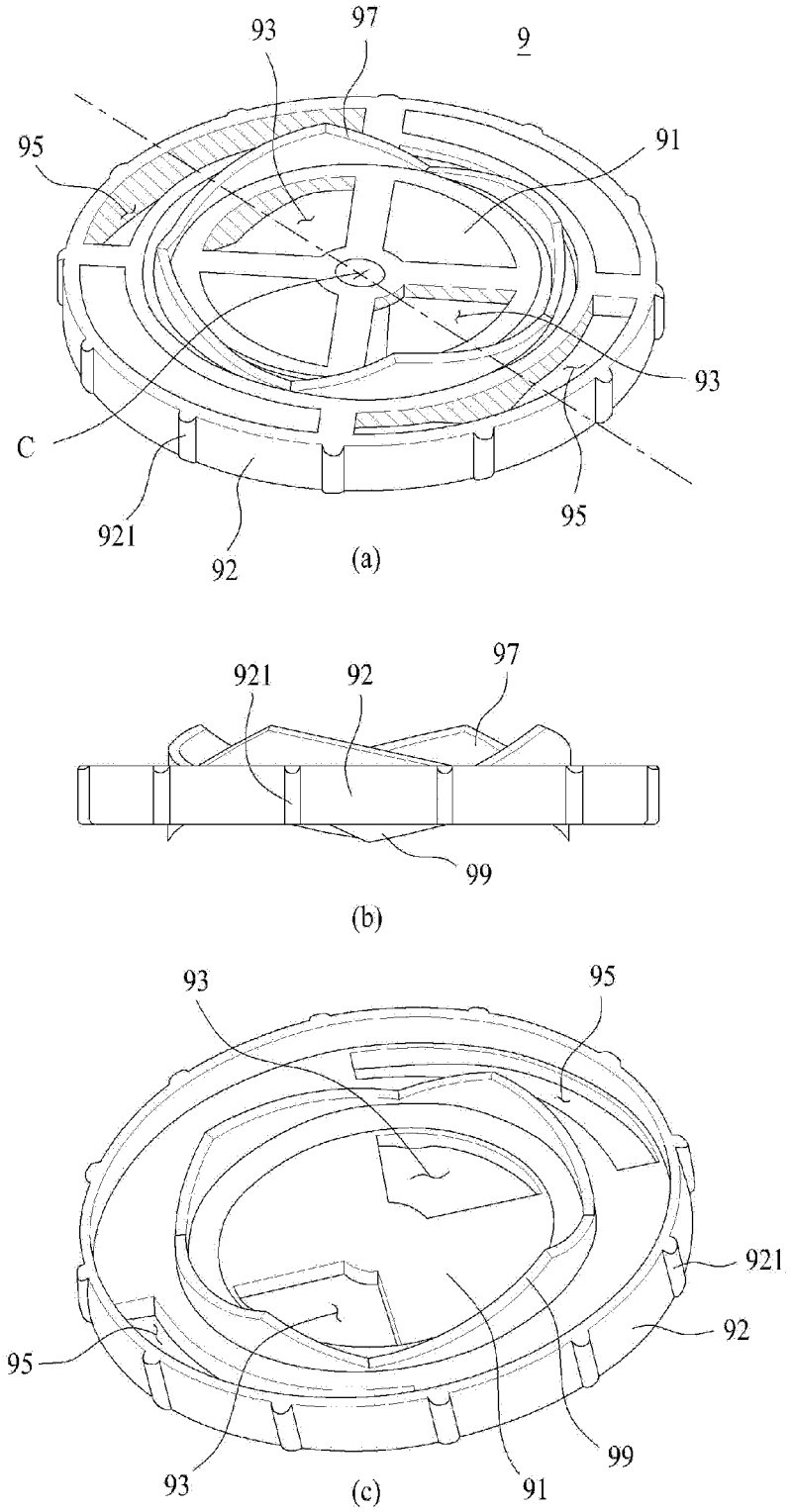
FIG. 7 is a perspective view showing an example channel change unit of the example dishwashing machine.
Figure 8A:
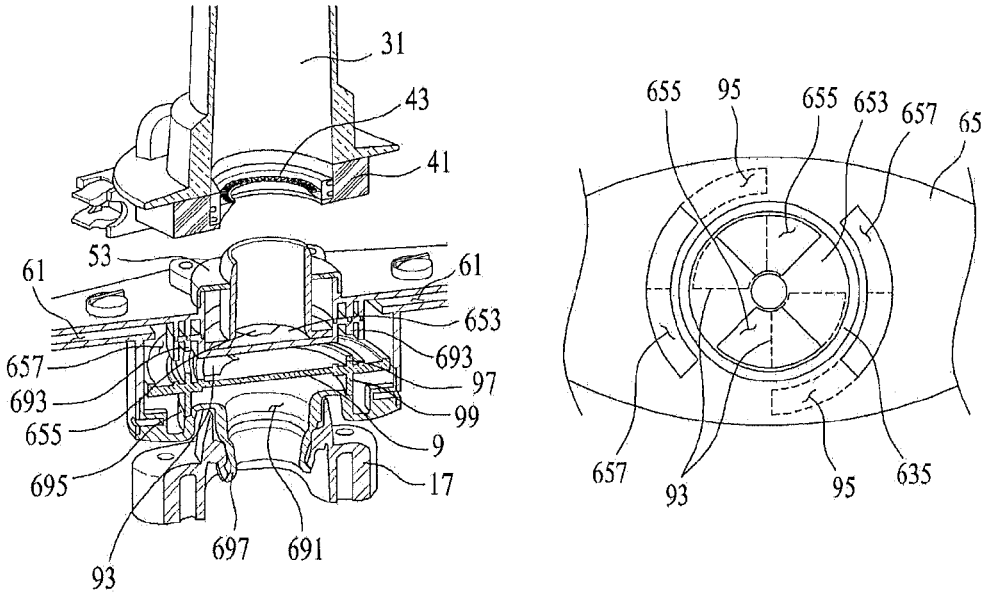
FIGS. 8A-8D are views showing motion of the example channel change unit of the example dishwashing machine.
Figure 8B:
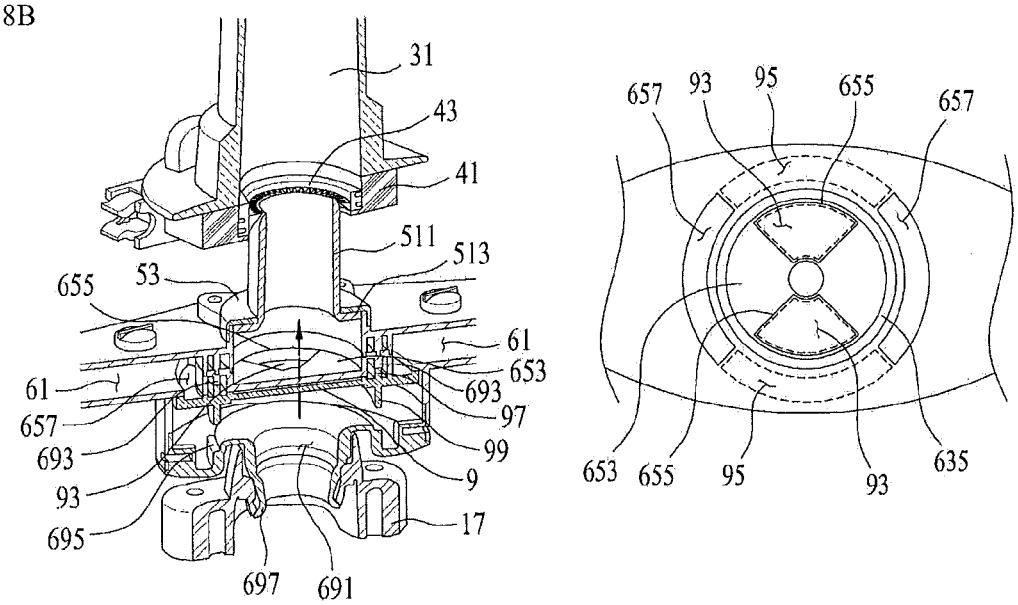
Figure 8C:
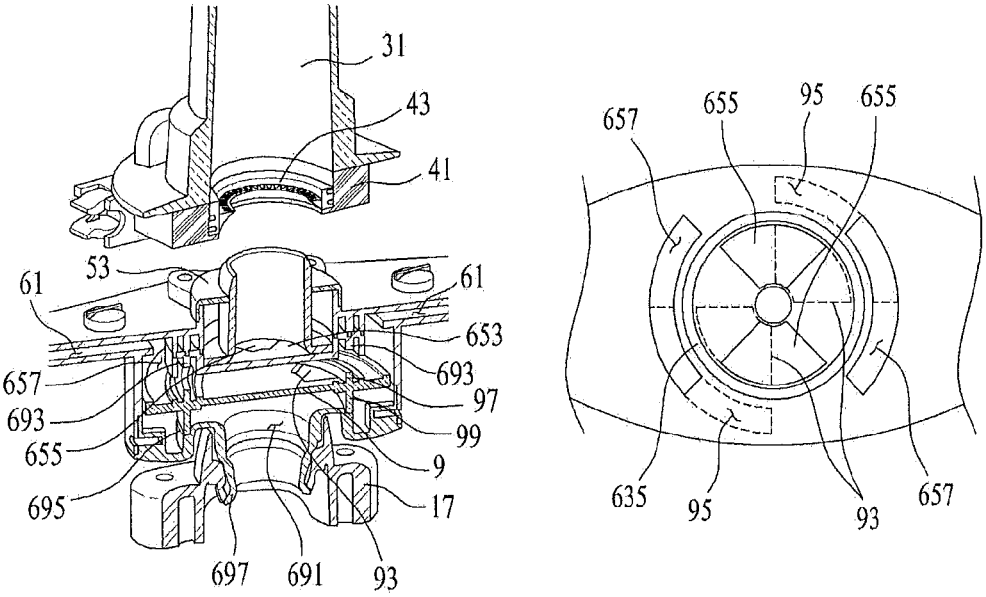
Figure 8D:
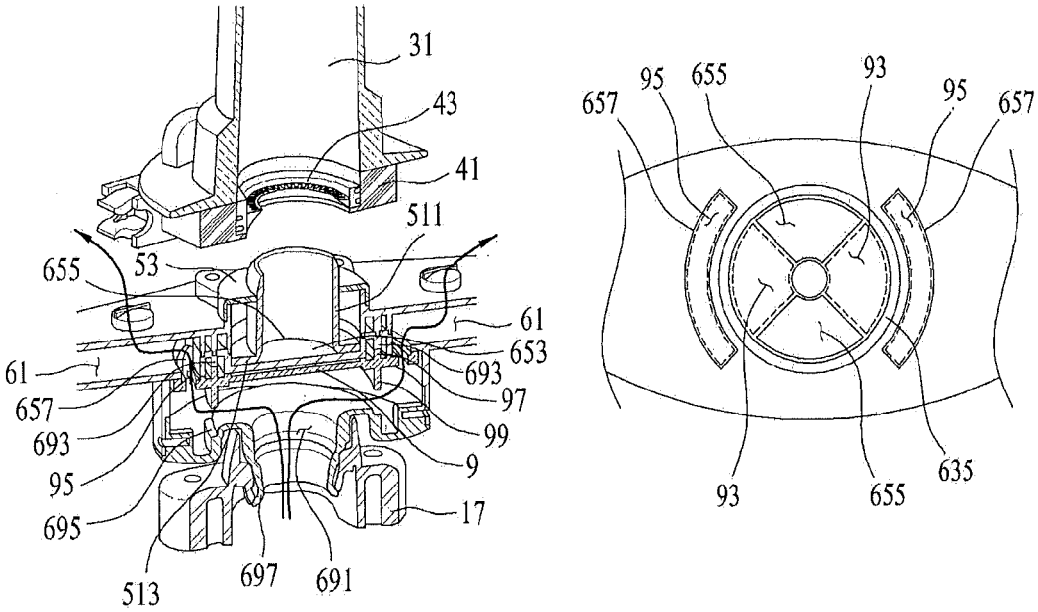

As shown in FIG. 7, the channel change unit 9 includes a change unit body 91 disposed in the lower arm chamber 69, chamber opening holes 93 formed through the change unit body 91 to open the chamber communication holes 655, and arm channel opening holes 95 formed through the change unit body 91 to open the arm channel communication holes 657.

The change unit body 91 is reciprocated between the bottom of the lower arm chamber 69 and the top of the lower arm chamber 69 depending upon water pressure in the lower arm chamber 69. The change unit body 91 may be formed in the shape of a disc.

That is, when the water pressure in the lower arm chamber 69 is high (when wash water is supplied to the lower arm chamber 69), the change unit body 91 moves from the bottom of the lower arm chamber 69 to the top of the lower arm chamber 69. On the other hand, when the water pressure in the lower arm chamber 69 is low (when wash water is not supplied to the lower arm chamber 69), the change unit body 91 moves from the top of the lower arm chamber 69 to the bottom of the lower arm chamber 69.

In addition, the change unit body 91 may be provided at the outer circumference thereof with a flange 92 to guide reciprocation of the change unit body 91.

The flange 92 contacts the inner circumference of the lower arm chamber 69 to guide reciprocation of the change unit body 91 and to assist the change unit body 91 in maintaining a horizontal orientation during reciprocation of the change unit body 91.

The flange 92 may be provided with a plurality of protrusions (change unit protrusions) 921 or a plurality of grooves to block foreign matter from being caught between the flange 92 and the inner circumference of the lower arm chamber 69.

In addition, the change unit body 91 is provided at the top thereof with an upper gear 97 coupled to the upper gear engagement unit 693 provided at the lower arm chamber 69 and the change unit body 91 is provided at the bottom thereof with a lower gear 99 coupled to the lower gear engagement unit 695.

The upper gear 97 is coupled to the upper gear engagement unit 693 to rotate the change unit body 91 in a clockwise direction (or in a counterclockwise direction) and the lower gear 99 is coupled to the lower gear engagement unit 695 to rotate the change unit body 91 in the clockwise direction (or in the counterclockwise direction).

The lower gear 99 and the lower gear engagement unit 695 rotate the change unit body 91 in a direction identical to the direction in which the change unit body 91 is rotated when the upper gear 97 is coupled to the upper gear engagement unit 693.

The upper gear 97 and the upper gear engagement unit 693 may be formed in a shape to rotate the change unit body 91 by a predetermined angle in a clockwise direction (or in a counterclockwise direction) when the upper gear 97 and the upper gear engagement unit 693 are coupled to each other. The lower gear 99 and the lower gear engagement unit 695 may be formed in a shape to rotate the change unit body 91 by a predetermined angle in the clockwise direction (or in the counterclockwise direction) when the lower gear 99 and the lower gear engagement unit 695 are coupled to each other.

In a case in which the chamber communication holes 655 and the arm channel communication holes 657 provided at the lower arm 6 are spaced apart from each other by 90 degrees as shown in FIG. 6, centers of the chamber opening holes 93 and centers of the arm channel opening holes 95 may be arranged on a straight line passing through a center of rotation C of the change unit body 91.

In this case, the upper gear engagement unit 693 and the upper gear 97 may be formed such that the change unit body 91 is rotated by 45 degrees in a clockwise direction (or in a counterclockwise direction) to open the chamber communication holes 655 or the arm channel communication holes 657 when the upper gear engagement unit 693 and the upper gear 97 are engaged with each other.

On the other hand, the lower gear engagement unit 695 and the lower gear 99 may be formed such that the change unit body 91 is rotated by 45 degrees in the clockwise direction (or in the counterclockwise direction) when the lower gear engagement unit 695 and the lower gear 99 are engaged with each other.

Unlike the above description, the chamber opening holes 93 and the arm channel opening holes 95 may be spaced apart from each other by 90 degrees on the basis of the center of rotation C of the change unit body 91 and the chamber communication holes 655 and the arm channel communication holes 657 may be arranged on a straight line.

Motion of the channel change unit 9 will be described with reference to FIG. 8. When the water supply pump 18 is not operated and thus wash water is not supplied to the lower arm chamber 69, the channel change unit 9 remains in contact with the bottom of the lower arm chamber 69 (see FIG. 8(*a*)).

In this case, the tower removable pipe 51 remains located in the removable pipe chamber 67 with the result that the removable pipe body 511 is not connected to the lower channel 31.

When the water supply pump 18 is operated and thus wash water is supplied to the arm holder 17 through the first channel 21, the upper arm 7 and the top nozzle 8 receive the wash water through the second channel 23 and the lower arm chamber 69 receives the wash water through the arm holder 17.

When the wash water is supplied to the lower arm chamber 69, the channel change unit 9 moves to the top of the lower arm chamber 69 with the result that the upper gear 97 is coupled to the upper gear engagement unit 693 (see FIG. 8(*b*)).

When the upper gear 97 and the upper gear engagement unit 693 are coupled to each other, the channel change unit 9 is rotated in the lower arm chamber 69 by 45 degrees in a clockwise direction with the result that the chamber opening holes 93 open the chamber communication holes 655.

At this time, the arm channel communication holes 657 remain closed by the change unit body 91 with the result that wash water is not supplied to the arm channel 61.

When the chamber communication holes 655 are opened by the chamber opening holes 93, wash water in the lower arm chamber 69 is introduced into the removable pipe chamber 67 (see an arrow). When the wash water is introduced into the removable pipe chamber 67, the tower removable pipe 51 is upwardly moved in the removable pipe chamber 67 by water pressure.

When the tower removable pipe 51 is upwardly moved in the removable pipe chamber 67, the removable pipe body 511 is inserted through the removable pipe receiving hole 431 of the rack fixing unit 4 with the result that the wash water in the removable pipe chamber 67 may be supplied to the tower channel 31.

When the operation of the water supply pump 18 is stopped, on the other hand, wash water is not supplied to the lower arm chamber 69 with the result that the channel change unit 9 moves to the bottom of the lower arm chamber 69 (see FIG. 8(*c*)).

When the channel change unit 9 moves to the bottom of the lower arm chamber 69, the lower gear 99 is coupled to the lower gear engagement unit 695 with the result that the channel change unit 9 is rotated by 45 degrees in a clockwise direction.

Consequently, centers of the chamber opening holes 93 and centers of the chamber communication holes 655 are spaced apart from each other by 45 degrees with the result that centers of the arm channel opening holes 95 and centers of the arm channel communication holes 657 are also spaced apart from each other by 45 degrees.

In addition, the removable pipe body 511 is separated from the removable pipe coupling unit 43 and then moves to the removable pipe chamber 67 with the result that the removable pipe body 511 is separated from the tower channel 31.

Subsequently, when wash water is resupplied to the lower arm chamber 69 through the water supply pump 18, the channel change unit 9 moves to the top of the lower arm chamber 69 with the result that the upper gear 97 is coupled to the upper gear engagement unit 693 (see FIG. 8(*d*)).

When the upper gear 97 and the upper gear engagement unit 693 are coupled to each other, the channel change unit 9 is rotated by 45 degrees in a clockwise direction with the result that the arm channel communication holes 657 are opened by the arm channel opening holes 95.

At this time, the chamber communication holes 655 remain closed by the change unit body 91 with the result that wash water is not supplied to the removable pipe chamber 67.

When the arm channel communication holes 657 are opened by the arm channel opening holes 95, wash water in the lower arm chamber 69 is introduced into the arm channel 61.

The wash water introduced into the arm channel 61 is sprayed (see arrows) to the lower rack 193 and the sump cover 15 through the upper spray holes 631 and the lower spray holes 651, respectively. At this time, the lower arm 6 is rotated about the arm holder connection pipe 697.

Subsequently, when the operation of the water supply pump 18 is temporarily stopped, wash water is not supplied to the lower arm chamber 69 with the result that the channel change unit 9 moves to the bottom of the lower arm chamber 69 (see FIG. 8(*a*)).

When the channel change unit 9 moves to the bottom of the lower arm chamber 69, the lower gear 99 is coupled to the lower gear engagement unit 695 with the result that the channel change unit 9 is rotated by 45 degrees in the clockwise direction.

Consequently, the centers of the chamber opening holes 93 and the centers of the chamber communication holes 655 are spaced apart from each other by 45 degrees with the result that the centers of the arm channel opening holes 95 and the centers of the arm channel communication holes 657 are also spaced apart from each other by 45 degrees.

As described above, the dishwashing machine is configured to have a structure in which the tower removable pipe 51 is coupled to the removable pipe coupling unit 43 to supply wash water to the tower channel 31. Consequently, it may be important to maintain airtightness between the tower removable pipe 51 and the removable pipe coupling unit 43. If such airtightness between the tower removable pipe 51 and the removable pipe coupling unit 43 is not maintained, it may be difficult for wash water introduced into the tower channel 31 to move to the spray nozzle 33.

More specifically, the lower rack 193 of the dishwashing machine is configured to be withdrawn from the tub 11. The rack fixing unit 4 is fixed to the lower rack 193 and the tower nozzle 3 is fixed to the rack fixing unit 4.

If a user fails to put the lower rack 193 at a proper place, therefore, the center of the removable pipe body 511 and the center of the removable pipe receiving hole 431 may not be aligned with each other.

In addition, the lower arm 6 of the dishwashing machine is rotatably coupled to the arm holder 17. If a horizontal orientation of the lower arm 6 is not maintained during rotation of the lower arm 6, the removable pipe body 511 may be separated from the removable pipe receiving hole 431.

Figure 9:
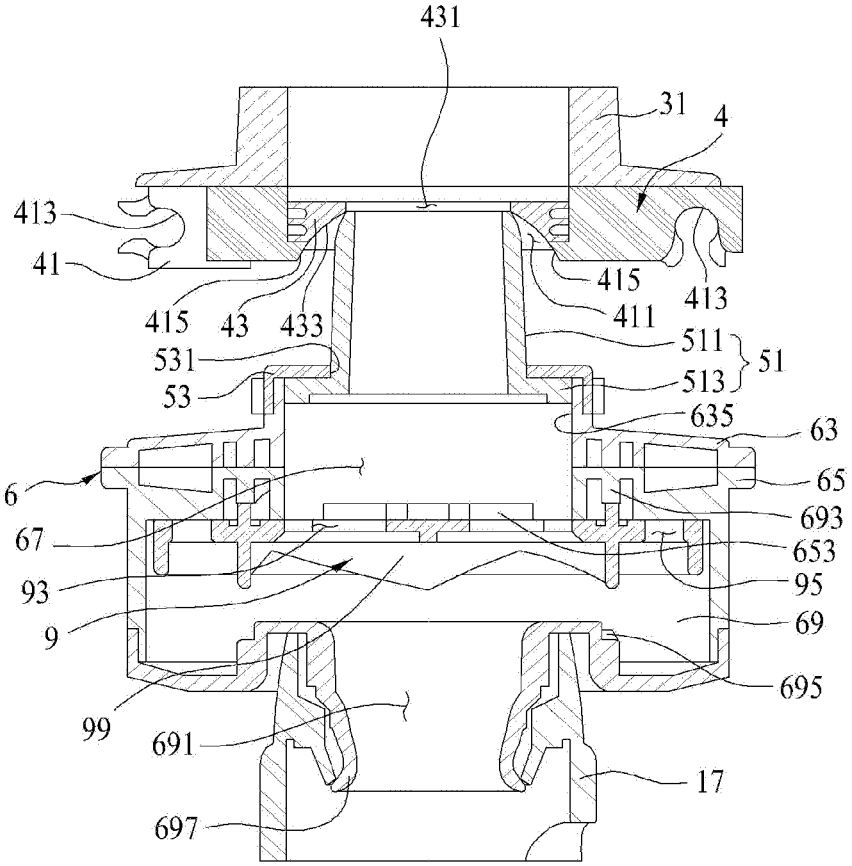
FIGS. 9 and 10 are views showing examples of the rack fixing unit of the dishwashing machine.
Figure 9:
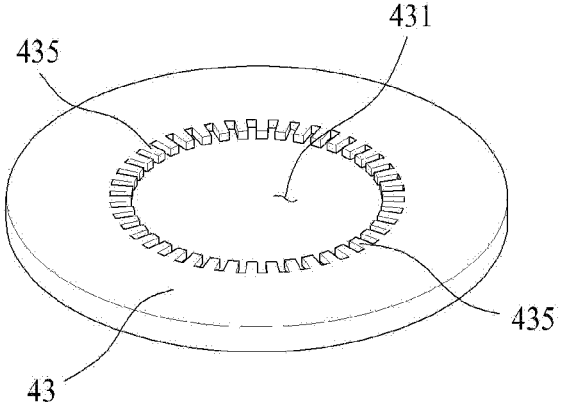
Figure 10:
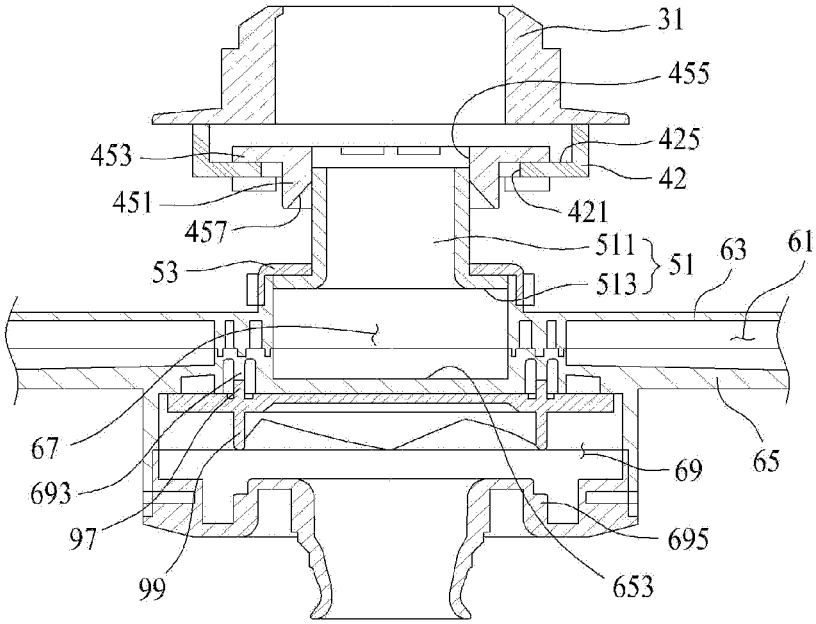
Figure 10:
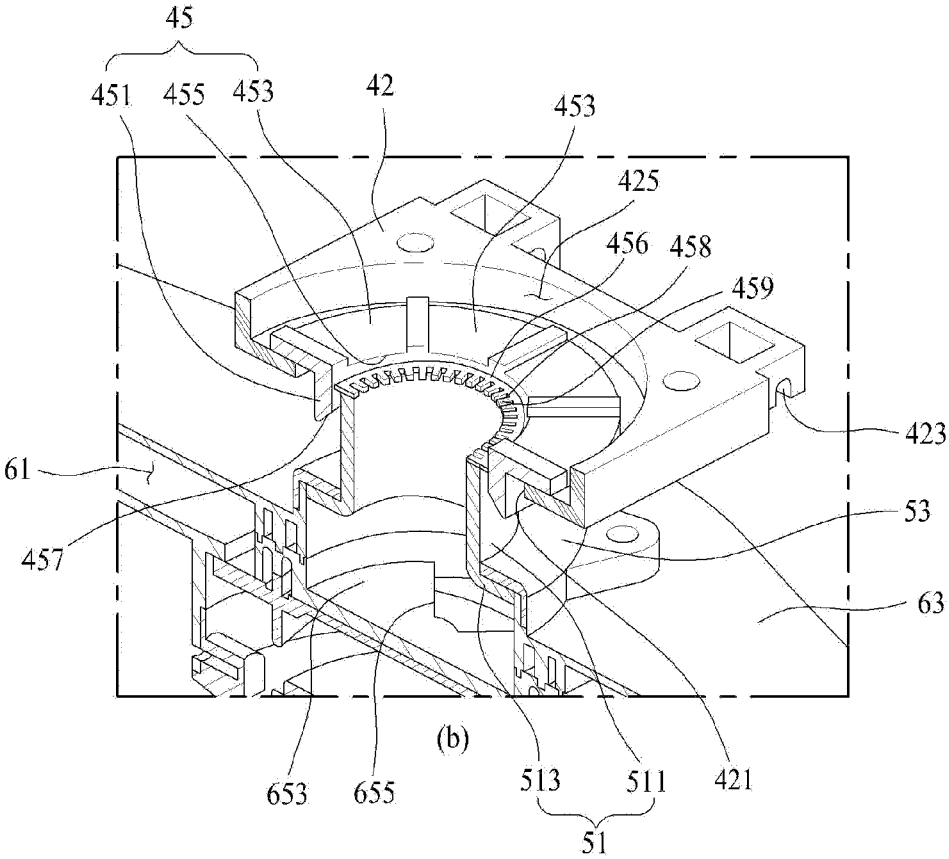

FIGS. 9 and 10 illustrate example structures of the rack fixing unit 4. In the examples shown in FIGS. 9 and 10, guides 415, 433, and 457 to maintain airtightness between the tower removable pipe 51 and the removable pipe coupling unit 43 are provided.

As shown in FIG. 9, the guide may be constituted by a first inclined surface 415 provided at the rack fixing body 41.

The first inclined surface 415 is provided at the inner circumference of the fixing body through hole 411 to guide the removable pipe body 511 to the removable pipe receiving hole 431.

That is, the first inclined surface 415 is provided at the inner circumference of the fixing body through hole 411 such that the first inclined surface 415 is inclined to the removable pipe receiving hole 431.

In addition, in the rack fixing unit 4, the removable pipe coupling unit 43 may be formed of an elastic material, such as rubber, and the guide may further include a second inclined surface 433 provided at the removable pipe coupling unit 43.

The second inclined surface 433 is inclined from the bottom of the removable pipe coupling unit 43 to the removable pipe receiving hole 431. The second inclined surface 433 is defined as a surface extending from the first inclined surface 415 to the removable pipe receiving hole 431.

Consequently, the removable pipe body 511 may be guided to the removable pipe receiving hole 431 by the guide (first inclined surface 415 and second inclined surface 433).

In addition, the removable pipe coupling unit 43 may further include a plurality of protrusions 435 provided along the removable pipe receiving hole 431 such that the protrusions 435 protrude toward the center of the removable pipe receiving hole 431.

The protrusions 435 may be formed of an elastic material. In this case, it is possible to complement airtightness between the removable pipe body 511 and the removable pipe receiving hole 431 even when the center of the removable pipe body 511 and the center of the removable pipe receiving hole 431 are not completely aligned with each other.

FIG. 10 illustrates another example of the rack fixing unit 4 included in the dishwashing machine. In this example, the rack fixing unit 4 includes a rack fixing body 42 removably fixed to the lower rack 193 and a removable pipe coupling unit 45, to which the removable pipe body 511 is coupled.

The rack fixing body 42 includes a rack coupling unit 423 to couple the rack fixing unit 4 to the lower rack 193, a flange location groove 425 formed by concavely bending the top of the rack fixing body 42, and a fixing body through hole 421 formed through the flange location groove 425.

In addition, the removable pipe coupling unit 45 includes a cylindrical coupling unit body 451 movably coupled to the fixing body through hole 421 of the rack fixing body 42 and a coupling unit flange 453 provided at the outer circumference of the coupling unit body 451.

The coupling unit body 451 is inserted through the fixing body through hole 421 such that the coupling unit body 451 protrudes toward the removable pipe body 511. The coupling unit body 451 is provided with a removable pipe receiving hole 455, which is formed through the center of the coupling unit body 451.

The outer circumference of the removable pipe body 511 is inserted into the removable pipe receiving hole 455.

The coupling unit flange 453 is provided at the outer circumference of the coupling unit body 451.

The diameter of the coupling unit body 451 is less than that of the fixing body through hole 421. The diameter of the coupling unit flange 453 is greater than that of the fixing body through hole 421 and less than that of the flange location groove 425.

Consequently, the coupling unit flange 453 is located in the flange location groove 425 to block the coupling unit body 451 from being withdrawn from the rack fixing body 42. In addition, the coupling unit body 451 may move in a state in which the coupling unit body 451 is inserted through the fixing body through hole 421.

In this case, the guide may be constituted by an inclined surface 457 provided at the coupling unit body 451 to guide the removable pipe body 511 to the removable pipe receiving hole 455.

The inclined surface 457 extends from the end of the coupling unit body 451 to the removable pipe receiving hole 455.

In the dishwashing machine shown in FIG. 10, the coupling unit body 451 is movably provided at the rack fixing body 42. Even in a case in which the center of the removable pipe body 511 and the center of the removable pipe receiving hole 455 are not aligned with each other due to incorrect arrangement of the lower rack 193 and a case in which the lower arm 6 is rotated in a state in which a horizontal orientation of the lower arm 6 is not maintained, it is possible to maintain airtightness between the removable pipe body 511 and the removable pipe receiving hole 455.

In addition, in the rack fixing unit 4 shown in FIG. 10, the removable pipe coupling unit 45 may be further provided with a sealing unit 456 (see FIG. 10(*b*)).

The sealing unit 456 may be provided at the inner circumference of the removable pipe receiving hole 455. In addition, the sealing unit 456 may be formed of an elastic material, such as rubber.

In this case, the sealing unit 456 may further include a sealing unit through hole 458 and a plurality of protrusions 459.

The sealing unit through hole 458 is formed through the sealing unit 456 such that wash water flows through the sealing unit 456. The protrusions 459 may be arranged along the sealing unit through hole 458 at predetermined intervals.

The protrusions 459 enable easy coupling between the removable pipe body 511 and the sealing unit 456 and, in addition, minimize leakage of wash water even when the center of the removable pipe body 511 and the center of the sealing unit through hole 458 are not aligned with each other.

In some implementations, a dishwashing machine includes a tub to provide a washing space, an upper rack and a lower rack disposed in the tub to receive objects to be washed, a lower arm disposed at a lower side of the lower rack to spray wash water to the lower rack, a water pump to supply wash water to the lower arm, a rack fixing unit provided at the lower rack, a tower nozzle fixed to the rack fixing unit such that the tower nozzle extends to the upper rack to spray wash water to the upper rack, and a tower connection unit withdrawn from the lower arm depending upon water pressure in the lower arm, the tower connection unit being connected to the tower nozzle to supply wash water to the tower nozzle when the tower connection unit is withdrawn from the lower arm, wherein the rack fixing unit includes a guide to guide the tower connection unit withdrawn from the lower arm to the tower nozzle.

The rack fixing unit may include a rack fixing body removably fixed to the lower rack, a fixing body through hole formed through the rack fixing body to communicate with the tower nozzle, a removable pipe coupling unit provided in the fixing body through hole, and a removable pipe receiving hole formed through the removable pipe coupling unit such that an outer circumference of the tower connection unit is inserted through the removable pipe receiving hole.

The guide may include a first inclined surface provided at the fixing body through hole such that the first inclined surface is inclined to the removable pipe receiving hole.

The guide may further include a second inclined surface provided at the removable pipe coupling unit such that the second inclined surface is connected to the first inclined surface, the second inclined surface being inclined to the removable pipe receiving hole.

The rack fixing unit may include a rack fixing body removably fixed to the lower rack, a fixing body through hole formed through the rack fixing body to communicate with the tower nozzle, and a removable pipe coupling unit movably provided in the fixing body through hole to connect the tower connection unit to the tower nozzle even when a center of the tower connection unit is not aligned with a center of the tower nozzle.

The rack fixing body may further include a flange location groove concavely bent toward the fixing body through hole and the removable pipe coupling unit may include a coupling unit body inserted through the fixing body through hole, a removable pipe receiving hole, through which an outer circumference of the tower connection unit is inserted, and a coupling unit flange provided at an outer circumference of the coupling unit body such that the coupling unit flange is supported in the flange location groove.

The coupling unit body may have a diameter less than a diameter of the fixing body through hole and the coupling unit flange may have a diameter greater than the diameter of the fixing body through hole and less than a diameter of the flange location groove.

The guide may include an inclined surface provided at the coupling unit body such that the inclined surface is inclined to the removable pipe receiving hole.

The removable pipe coupling unit may further include a sealing unit provided in the removable pipe receiving hole such that the sealing unit contacts the outer circumference of the tower connection unit.

The sealing unit may be formed of an elastic material and the sealing unit may further include a sealing unit through hole in which the outer circumference of the tower connection unit is received and a plurality of protrusions provided at the sealing unit through hole such that the protrusions are arranged at predetermined intervals.

In accordance with the above description, a dishwashing machine may have improved washing efficiency and, in addition, may efficiently utilize a space of a tub in which objects to be washed are received.

In addition, a dishwashing machine may include a spray arm to spray wash water to a lower rack and a tower nozzle to supply wash water to an upper rack.

Further, a dishwashing machine may supply wash water selectively between a channel to supply the wash water to a spray arm and a channel to supply the wash water to a tower nozzle through a channel change unit configured to be rotated depending upon water pressure of the wash water.

In addition, a dishwashing machine may be able to reduce (e.g., prevent) wash water supplied to a tower nozzle from leaking out of the tower nozzle.

It will be apparent to those skilled in the art that various modifications and variations can be made without departing from the spirit or scope of the disclosure. Thus, it is intended that the present disclosure covers the modifications and variations of this invention provided they come within the scope of the appended claims and their equivalents.

What is claimed is:

1. A dishwashing machine comprising:

a tub configured to define a washing space;

an upper rack and a lower rack disposed in the tub and configured to receive objects to be washed;

a lower arm disposed at a lower side of the lower rack and configured to spray wash water to the lower rack;

a rack fixing unit provided at the lower rack;

a tower nozzle fixed to the rack fixing unit and configured to spray wash water to the upper rack; and a tower connection unit provided in the lower arm and configured to move from the lower arm based on water pressure in the lower arm, the tower connection unit being connected to the tower nozzle to supply wash water to the tower nozzle based on the tower connection unit being moved from the lower arm, wherein the rack fixing unit comprises a guide to guide movement of the tower connection unit from the lower arm to the tower nozzle.

2. The dishwashing machine according to claim 1, wherein the rack fixing unit comprises:

a rack fixing body removably fixed to the lower rack, the rack fixing body having a fixing body through hole that communicates with the tower nozzle; and a removable pipe coupling unit provided in the fixing body through hole, the removable pipe coupling unit having a removable pipe receiving hole through which an outer circumference of the tower connection unit is inserted.

3. The dishwashing machine according to claim 2, wherein the guide comprises a first inclined surface provided at the fixing body through hole such that the first inclined surface is inclined to the removable pipe receiving hole.

4. The dishwashing machine according to claim 3, wherein the guide further comprises a second inclined surface provided at the removable pipe coupling unit such that the second inclined surface is connected to the first inclined surface, the second inclined surface being inclined to the removable pipe receiving hole.

5. The dishwashing machine according to claim 1, wherein the rack fixing unit comprises:

a rack fixing body removably fixed to the lower rack, the rack fixing body having a fixing body through hole that communicates with the tower nozzle; and a removable pipe coupling unit movably provided in the fixing body through hole to facilitate connection between the tower connection unit and the tower nozzle even when a center of the tower connection unit is not aligned with a center of the tower nozzle.

6. The dishwashing machine according to claim 5:

wherein the rack fixing body further comprises a flange location groove concavely bent toward the fixing body through hole, and wherein the removable pipe coupling unit comprises a coupling unit body inserted through the fixing body through hole, a removable pipe receiving hole, through which an outer circumference of the tower connection unit is inserted, and a coupling unit flange provided at an outer circumference of the coupling unit body such that the coupling unit flange is supported in the flange location groove.

7. The dishwashing machine according to claim 6:

wherein the coupling unit body has a diameter less than a diameter of the fixing body through hole, and wherein the coupling unit flange has a diameter greater than the diameter of the fixing body through hole and less than a diameter of the flange location groove.

8. The dishwashing machine according to claim 7, wherein the guide comprises an inclined surface provided at the coupling unit body such that the inclined surface is inclined to the removable pipe receiving hole.

9. The dishwashing machine according to claim 8, wherein the removable pipe coupling unit further comprises a sealing unit provided in the removable pipe receiving hole such that the sealing unit contacts the outer circumference of the tower connection unit.

10. The dishwashing machine according to claim 9:

wherein the sealing unit is formed of an elastic material, and wherein the sealing unit further comprises:

a sealing unit through hole in which the outer circumference of the tower connection unit is received; and a plurality of protrusions provided at the sealing unit through hole such that the protrusions are arranged at predetermined intervals.

11. The dishwashing machine according to claim 1, further comprising:

a water supply pump configured to supply wash water, wherein the in the lower arm is caused by operation of the water supply pump.

12. The dishwashing machine according to claim 11, wherein the tower connection unit is configured to disconnect from the tower nozzle and move to the lower arm based on a reduction in water pressure on the tower connection unit caused by discontinuing operation of the water supply pump.

13. The dishwashing machine according to claim 1, wherein the tower connection unit is configured to alternate between connecting water supply to the tower nozzle and connecting water supply to the lower arm each time the tower connection unit moves from the lower arm.

14. The dishwashing machine according to claim 1, wherein the tower connection unit is configured to rotate each time the tower connection unit moves from the lower arm and connects to the tower nozzle and each time the tower connection unit disconnects from the tower nozzle and moves to the lower arm.

15. The dishwashing machine according to claim 14, wherein the tower connection unit is configured to, at a first angle of rotation, connect water supply to the tower nozzle and block water supply to the lower arm and, at a second angle of rotation that is different than the first angle of rotation, connect water supply to the lower arm and block water supply to the tower nozzle.

16. A dishwashing machine comprising:

a tub configured to define a washing space;

an upper rack and a lower rack disposed in the tub and configured to receive objects to be washed;

a lower arm comprising a lower arm chamber, into which wash water is introduced, a removable pipe chamber communicating with the lower arm chamber via a chamber communication hole, and an arm channel communicating with the lower arm chamber via an arm channel communication hole, the arm channel being configured to spray wash water to the lower rack;

a rack fixing unit provided at the lower rack;

a tower nozzle fixed to the rack fixing unit and configured to spray wash water to the upper rack; and a tower connection unit provided in the removable pipe chamber, the tower connection unit being moved from the removable pipe chamber and connected to the tower nozzle based on water pressure in the removable pipe chamber, wherein the rack fixing unit comprises a guide configured to guide movement of the tower connection unit from the removable pipe chamber to the tower nozzle.

17. The dishwashing machine according to claim 16, further comprising:

a water supply pump configured to supply wash water to the lower arm chamber; and a channel change unit provided in the lower arm chamber and configured to alternately open the chamber communication hole and the arm channel communication hole depending upon water pressure in the lower arm chamber controlled by the water supply pump.

18. The dishwashing machine according to claim 17, wherein the channel change unit comprises:

a change unit body configured to reciprocate and rotate in the lower arm chamber depending upon the water pressure in the lower arm chamber, the change unit body having a chamber opening hole configured to open the chamber communication hole depending upon a rotational angle of the change unit body and an arm channel opening hole configured to open the arm channel communication hole depending upon the rotational angle of the change unit body.

19. The dishwashing machine according to claim 18:

wherein the lower arm chamber further comprises an introduction hole, through which wash water is introduced, a lower gear engagement unit provided to surround the introduction hole, and an upper gear engagement unit provided at an upper side of the lower arm chamber, and wherein the channel change unit further comprises:

an upper gear provided at a top of the change unit body such that the upper gear is engaged with the upper gear engagement unit and rotates the change unit body such that, based on the upper gear being coupled to the upper gear engagement unit, the chamber opening hole opens the chamber communication hole or the arm channel opening hole opens the arm channel communication hole; and a lower gear provided at a bottom of the change unit body such that the lower gear is engaged with the lower gear engagement unit and rotates the change unit body such that, based on the lower gear being coupled to the lower gear engagement unit, the chamber opening hole opens the chamber communication hole or the arm channel opening hole opens the arm channel communication hole.

20. The dishwashing machine according to claim 19, wherein the upper gear and the lower gear are configured to alternately rotate the change unit body such that the chamber opening hole opens the chamber communication hole a first instance in which the upper gear is coupled to the upper gear engagement unit and the arm channel opening hole opens the arm channel communication hole a second instance in which the upper gear is coupled to the upper gear engagement unit, the second instance immediately following the first instance.

* * * * *